US007562875B2

(12) United States Patent
Morin et al.

(10) Patent No.: US 7,562,875 B2
(45) Date of Patent: Jul. 21, 2009

(54) GAMING SYSTEMS AND METHODS

(75) Inventors: Russell Morin, Omaha, NE (US); David Gray, Ontario (CA); Daniel Free, Manitoba (CA)

(73) Assignee: VKGS LLC, Des Moines, IA (US)

( * ) Notice: Subject to any disclaimer, the term of this patent is extended or adjusted under 35 U.S.C. 154(b) by 223 days.

(21) Appl. No.: 11/241,246

(22) Filed: Sep. 30, 2005

(65) Prior Publication Data

US 2006/0131804 A1 Jun. 22, 2006

Related U.S. Application Data

(60) Provisional application No. 60/615,149, filed on Oct. 1, 2004.

(51) Int. Cl.

| | |
|---|---|
| ***A63F 3/06*** | (2006.01) |
| ***A63F 9/00*** | (2006.01) |
| ***A63F 3/00*** | (2006.01) |
| ***A63F 9/24*** | (2006.01) |
| ***G06F 13/00*** | (2006.01) |
| ***G06F 17/00*** | (2006.01) |

(52) U.S. Cl. ..... 273/269; 273/148 R; 273/246; 463/19; 463/16; 463/30

(58) Field of Classification Search ..... 273/269, 273/246, 148; 463/19, 30, 16

See application file for complete search history.

(56) References Cited

U.S. PATENT DOCUMENTS

| | | | | |
|---|---|---|---|---|
| 4,218,063 | A * | 8/1980 | Cooper et al. | 273/237 |
| 4,775,155 | A | 10/1988 | Lees | |
| 5,139,270 | A | 8/1992 | Gernhofer | 273/269 |
| 5,160,146 | A * | 11/1992 | Greer | 273/269 |
| 5,269,523 | A * | 12/1993 | Boylan et al. | 273/138.1 |
| 5,472,209 | A * | 12/1995 | Goldfarb | 463/19 |
| 5,657,991 | A * | 8/1997 | Camarato | 273/269 |
| 5,718,631 | A * | 2/1998 | Invencion | 463/19 |
| 5,938,200 | A * | 8/1999 | Markowicz et al. | 273/246 |
| 6,398,645 | B1 * | 6/2002 | Yoseloff | 463/19 |
| 6,409,173 | B1 | 6/2002 | Tri | 273/292 |
| 6,585,266 | B1 | 7/2003 | Lovell | 273/269 |
| 6,729,959 | B1 * | 5/2004 | Moore et al. | 463/30 |
| 2002/0111207 | A1 * | 8/2002 | Lind et al. | 463/19 |
| 2004/0116180 | A1 * | 6/2004 | Gerow | 463/27 |
| 2004/0251628 | A1 * | 12/2004 | Kilby | 273/269 |
| 2005/0020340 | A1 * | 1/2005 | Cannon | 463/16 |

* cited by examiner

*Primary Examiner*—Gene Kim
*Assistant Examiner*—Michael D Dennis
(74) *Attorney, Agent, or Firm*—Fredrikson & Byron, P.A.

(57) ABSTRACT

The invention relates generally to methods and apparatus for playing games involving numbers or symbols, including but not limited to the classic game of BINGO. More particularly, the methods and apparatus relate to games involving matrices or arrays of numbers or symbols and different techniques and/or equipment used when playing the games, which help define how the games are won.

18 Claims, 10 Drawing Sheets

| | | | | | | | | | | | | | | | |
|---|---|---|---|---|---|---|---|---|---|---|---|---|---|---|---|
| B | 1 | 2 | 3 | 4 | 5 | 6 | 7 | 8 | 9 | 10 | 11 | 12 | 13 | 14 | 15 |
| I | 16 | 17 | 18 | 19 | 20 | 21 | 22 | 23 | 24 | 25 | 26 | 27 | 28 | 29 | 30 |
| N | 31 | 32 | 33 | 34 | 35 | 36 | 37 | 38 | 39 | 40 | 41 | 42 | 43 | 44 | 45 |
| G | 46 | 47 | 48 | 49 | 50 | 51 | 52 | 53 | 54 | 55 | 56 | 57 | 58 | 59 | 60 |
| O | 61 | 62 | 63 | 64 | 65 | 66 | 67 | 68 | 69 | 70 | 71 | 72 | 73 | 74 | 75 |

FIG. 1

| B | I | N | G | O |
|---|---|---|---|---|
| 12 | 27 | 42 | 57 | 72 |
| 3 | 18 | 33 | 48 | 63 |
| 14 | 22 | | 59 | 61 |
| 6 | 21 | 36 | 51 | 66 |
| 15 | 24 | 39 | 52 | 68 |

FIG. 2

| | | | | | | | | | |
|---|---|---|---|---|---|---|---|---|---|
| 1 | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 38 | 39 | 40 |
| 41 | 42 | 43 | 44 | 45 | 46 | 47 | 48 | 49 | 50 |
| 51 | 52 | 53 | 54 | 55 | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |
| 81 | 82 | 83 | 84 | 85 | 86 | 87 | 88 | 89 | 90 |
| 91 | 92 | 93 | 94 | 95 | 96 | 97 | 98 | 99 | 100 |

FIG. 4

| B | I | N | G | O |
|---|---|---|---|---|
| 8 | 23 | 38 | 53 | 68 |
| 10 | 26 | 44 | 47 | 72 |
| 7 | 17 | FREE 1 | 56 | 70 |
| 1 | 24 | 39 | 49 | 65 |
| 5 | 21 | 33 | 54 | 64 |

| B | I | N | G | O |
|---|---|---|---|---|
| 11 | 26 | 41 | 56 | 71 |
| 6 | 18 | 36 | 47 | 65 |
| 7 | 20 | FREE 2 | 46 | 69 |
| 4 | 29 | 38 | 60 | 74 |
| 12 | 30 | 35 | 59 | 70 |

| B | I | N | G | O |
|---|---|---|---|---|
| 5 | 20 | 35 | 50 | 65 |
| 4 | 30 | 32 | 49 | 71 |
| 6 | 16 | FREE 3 | 57 | 75 |
| 3 | 18 | 43 | 53 | 67 |
| 13 | 17 | 36 | 51 | 70 |

GAMING SYSTEMS AND METHODS

CROSS-REFERENCE TO RELATED APPLICATION

The present application claims priority to, U.S. provisional patent application filed Oct. 1, 2004 and assigned Ser. No. 60/615,149, the entire disclosure of which is incorporated herein by reference.

FIELD OF THE INVENTION

The invention relates generally to games, and methods and apparatus regarding such games. More particularly, the method and apparatus relate to different techniques followed and/or equipment used when playing and winning such games.

BACKGROUND

The game of BINGO comprises one of the most widely known and universally played games. Participants play BINGO in a wide variety of social settings including homes, church halls, and casinos. Regardless of the specific form and nature of the playing environment, the rules generally remain the same. In order to play, participants generally need to be furnished with at least one BINGO card.

Generally, the BINGO card face includes a 5×5 matrix or array (five rows by five columns) of twenty-five spaces. At the top of each column appears one letter from the word BINGO, in order from left to right. In other words, at the top of the first column appears the letter "B". At the top of the second column appears the letter "I", and so forth. In each of the twenty-five spaces under the letter headings appears a symbol (or a symbol combination, including a combination involving one or more symbols). Each symbol is only used once in the matrix of spaces. For example, in the first column under the letter "B", in each of the spaces, a number appears between one and fifteen; in the second column under the letter "I", in each of the spaces, a number appears between sixteen and thirty; in the third column under the letter "N", in each of the spaces, a number appears between thirty-one and forty-five; in the fourth column under the letter "G", in each of the spaces, a number appears between forty-six and sixty; and finally in the fifth column under the letter "O", in each of the spaces, a number appears between sixty-one and seventy-five.

Within the parameters set forth, the numbers that correspond to each column appear somewhat jumbled in order to maximize the number of unique arrangements for each BINGO card. As mentioned above, each number may only appear once on the matrix of a BINGO card. A common variation for this format includes replacing the symbol in the centermost space with a free space. In other words, in column three (under the letter "N") and in row three, a free space appears in that space.

Typically, the playing of the BINGO game commences with the drawing of a symbol. For example, a caller calls out the particular symbol selected to the participants of the BINGO game. In other instances, the selection is communicated to the participants by some other means. Next, each player searches their BINGO card for the occurrence of the particular symbol that was communicated. If the particular symbol appears on a participant's BINGO card, the participant generally marks that space, for example, by placing a marker over that space, or by using a dauber and permanently marking that particular space to indicate a match. This symbol selection process continues in the same manner, with new symbols being selected and communicated, and then subsequently marked by the players, until a participant achieves a certain arrangement of matches, including but not limited to, matches in either a horizontal, vertical, or diagonal row on the BINGO card in the case of a single line game. At this point, the participant that achieved such arrangement shouts out "BINGO" and wins the game, along with any associated prize if applicable.

While the game of BINGO proves fascinating to many, certain limitations do exist. One such limitation involves not being able to know how the game is progressing as more and more symbols are called. In turn, the participants have no idea when a certain number is going to produce a winner. As such, it is easy to lose interest even while playing if your specific symbols are not being called consistently.

SUMMARY OF THE INVENTION

The present invention provides many embodiments, some of which are discussed below. Certain embodiments of games are provided herein which use matrices of numbers, wherein the representation of the numbers in the matrix dictates how winners of the game are determined. In addition, certain embodiments of games are provided herein which involve certain events occurring during the playing of the games, wherein the specific order by which the events occur dictates how winners of the game are determined. Further, certain embodiments of games are provided herein where a visual display is used to illustrate the timeline and/or various stages of the game, wherein participants of the game are able to use the display to see how the game is progressing and how the game may be won.

Certain embodiments of the invention provide a gaming system comprising a flashboard and a set of cards for use with the flashboard. The Dashboard includes a matrix of spaces, with each flashboard matrix space being occupied by a symbol, with each symbol being distinct. Each symbol is located in one of a plurality of rows extending across the flashboard matrix in a first direction and in one of a plurality of columns extending across the flashboard matrix in a second direction. Each of the set of cards includes at least one matrix of spaces, with each card matrix being occupied by a set of the symbols in the flashboard matrix. Each set of symbols extends across each card matrix in a plurality of groupings. The symbols of at least one of the plurality of groupings in each card matrix matches the symbols of at least one of the plurality of rows and the plurality of columns in the flashboard matrix.

Additionally, certain embodiments of the invention provide a method of playing a game. The method includes a step of providing a flashboard including a matrix of spaces used for the game, where each flashboard matrix space is occupied by a symbol, with each symbol being distinct. Each symbol is located in one of a plurality of rows extending across the Dashboard matrix in a first direction and in one of a plurality of columns extending across the Dashboard matrix in a second direction. Another step includes providing a set of cards configured for use with the flashboard, where each of the set of cards includes at least one matrix of spaces. Each card matrix is occupied by a set of the symbols in the flashboard matrix, with each set of symbols extending across each card matrix in a plurality of groupings. The symbols of at least one of the plurality of groupings in each card matrix matches the symbols of at least one of the plurality of rows and the plurality of columns in the flashboard matrix. Further steps include distributing one or more of the set of cards to participants of the game, playing the game by selecting randomly a plurality of distinct symbols of the flashboard matrix, and winning the game when symbols of one or more groupings on one or more card matrixes on one of the cards distributed to one of the participants have been selected.

Also, certain embodiments of the invention provide a gaming system comprising a flashboard a set of tickets configured for use with the flashboard. The flashboard includes a matrix of spaces, with each flashboard matrix space being occupied by a symbol, with each symbol being distinct. Each symbol is located in one of a plurality of rows extending across the flashboard matrix in a first direction and in one of a plurality of columns extending across the flashboard matrix in a second direction. One of the plurality of rows and the plurality of columns are each assigned a number, with each assigned number being distinct. Each of the set of tickets includes a set of two or more of the distinct numbers incorporated thereon, with each set of two or more distinct numbers being distinct.

In addition, certain embodiments of the invention provide a method of playing a game. The method includes a step of providing a flashboard including a matrix of spaces used for the game, with each flashboard matrix space being occupied by a symbol, with each symbol being distinct. Each symbol is located in one of a plurality of rows extending across the flashboard matrix in a first direction and in one of a plurality of columns extending across the flashboard matrix in a second direction. One of the plurality of rows and the plurality of columns are each assigned a number, with each assigned number being distinct. Another step includes providing a set of tickets configured for use with the flashboard. Each of the set of tickets includes a set of two or more of the distinct numbers incorporated thereon, with each set of two or more distinct numbers being distinct. Further steps include distributing one or more of the set of tickets to participants of the game; playing the game by selecting randomly a plurality of the distinct symbols of the flashboard matrix; and winning the game when the symbols of the one of the plurality of rows and the plurality of columns corresponding to the distinct numbers on one of the tickets distributed to one of the participants have been selected.

Further, certain embodiments of the invention provide a method of playing a game. The method includes a step of providing a visual display illustrating a contest including a plurality of contestants and a distinct plurality of events needing to occur for each contestant to finish the contest. Each contestant corresponds to one of a set of distinct numbers. Another step includes providing a set of tickets configured for use with the visual display. Each of the set of tickets includes a set of two or more of the distinct numbers incorporated thereon, with each set of the two or more distinct numbers being distinct. Additionally, a step includes distributing one or more of the set of tickets to participants of the game. Further, a step includes playing the game by selecting randomly a plurality of distinct symbols from a matrix, each distinct symbol selection corresponding to one of the events occurring for one of the contestants. Also, another step includes winning the game when the distinct symbols defining the events needed for completion of the contest for one or more of the contestants corresponding to the distinct numbers on one of the tickets distributed to one of the game participants have been selected.

BRIEF DESCRIPTION OF THE DRAWINGS

FIG. 1 is a plan view of a BINGO flashboard in accordance with exemplary embodiments of the invention;

FIG. 2 is a plan view of a BINGO card in accordance with exemplary embodiments of the invention;

FIG. 4 is plan view of a set of potential lottery number selections distributed in a matrix in accordance with exemplary embodiments of the invention;

DETAILED DESCRIPTION

Figure 3:
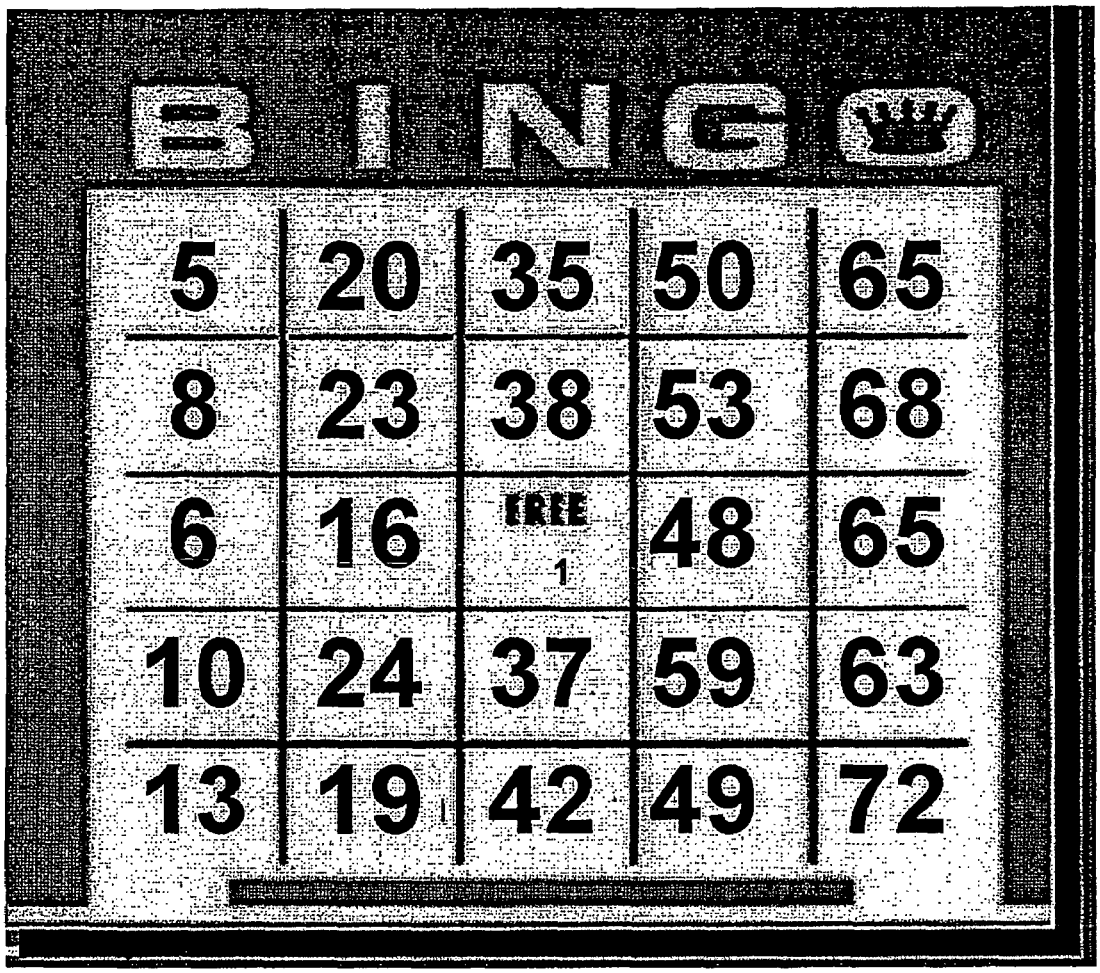
FIG. 3 is a plan view of a BINGO card in accordance with exemplary embodiments of the invention.

The following detailed description is to be read with reference to the figures. The figures depict selected embodiments, but are not intended to limit the scope of the invention. It will be understood that many of the specific steps of the methods and apparatus incorporating the inventive system illustrated in the figures could be changed or modified by one of ordinary skill in the art without departing significantly from the spirit of the invention.

As described above, the game of BINGO is played when symbols (or symbol combinations) are randomly selected and then communicated to participants, who subsequently mark the symbols on their respective BINGO cards if the symbols are located thereon. Generally, as each symbol is called, the symbol is subsequently displayed on a BINGO flashboard. The appearance of the BINGO flashboard, which holds a visual record of all the previously selected symbols, is generally used to allow participants to view which symbols have previously been selected. One exemplary BINGO flashboard is shown in FIG. 1. As illustrated, a typical BINGO flashboard is made up of a certain number of rows and a certain number of columns. FIG. 1 shows one example of a BINGO flashboard having five rows, with each row having fifteen spaces therein, wherein the five rows are filled with numbers from 1 to 75. In certain embodiments, an additional space is included with each of the five rows, wherein the additional spaces are included to each hold one of the five letters that make up the word "BINGO". These additional spaces, holding the letters, "B", "I", "N", "G", and "O", in certain embodiments, are located in the first space of each row, with the letters being vertically inserted down the first spaces so that the word "BINGO" is formed when reading the first spaces from top to bottom.

The other fifteen spaces of each row are subsequently used to show the corresponding numbers in order for each letter, accordingly to the numbers associated with each letter as described above. For example, the letter "B" is associated with the numbers 1 through 15, the letter "I" is associated with the numbers 16 through 30, the letter "N" is associated with the numbers 31 through 45, the letter "G" is associated with the numbers 46 through 60, and the letter "O" is associated with the numbers 61 through 75. In certain embodiments, going from left to right on the BINGO flashboard, the first row of fifteen spaces following the letter "B", from left to right, has the numbers 1 to 15 inserted in ascending order, the second row of fifteen spaces following the letter "I", from left to right, has the numbers 16 to 30 inserted in ascending order, and so on for the third row of fifteen spaces following the letter "N", and the fourth row of spaces following the letter "G", and the last row following the letter "O".

In summary, as illustrated in FIG. 1, one exemplary BINGO flashboard may include five rows making up sixteen columns. Each column includes five spaces, and in certain embodiments, one of the columns, e.g., the first, includes five letters forming the word "BINGO", while the other fifteen include the numbers from 1 to 75. With the numbers 1 to 75 being laid out in the order as described above, each of the fifteen columns of numbers include a first space that has a number from 1 to 15. In turn, for each column, from top to bottom, the numbers are staggered in multiples of fifteen. In certain embodiments, for example, the column of numbers beginning with the number 1 would have subsequent numbers of 16, 31, 46, and 61 filling the other four spaces of the column from top to bottom. This staggering of numbers would also be similar for each of the columns starting with numbers 2 through 15, so that each of the numbers 16 through 75 are divided up accordingly by the fifteen columns containing numbers.

As such, one would have fifteen different columns of five numbers each, and the numbers of each column would each be multiples of fifteen. In certain embodiments, the first number of each row would correspond with the number associated with each column. For example, the 4th column of numbers would include the numbers 4, 19, 34, 49, and 64, whereas the 9th column would include the numbers 9, 24, 39, 54, and 69. In certain embodiments, the method and apparatus of playing a BINGO game could be altered using these columns of the BINGO Dashboard in particular fashions, as described below.

As described above, a BINGO game is generally played by participants who generally mark spaces on their respective BINGO cards for particular symbols that are randomly selected and communicated to the participants. The BINGO game continues until a participant achieves a certain arrangement of marks on their BINGO cards. For example, such arrangement may include, but should not be limited to, a horizontal, vertical, or diagonal series of marks. At this point, the participant that establishes such an arrangement shouts out "BINGO" and wins the game, along with any associated prize if applicable.

In certain embodiments, using the columns of the BINGO Dashboard in particular fashions, the game can be altered; however, the essential elements of the game would remain unchanged. Participants would still generally mark spaces on their respective BINGO cards for particular symbols that are selected and communicated. In addition, the BINGO game would generally continue until a participant achieved the arrangement of marks on their BINGO cards that constitutes a winner. However, the BINGO cards would be altered so as to alter the game.

As exemplified in FIG. 2, in certain embodiments, a BINGO card would now include one or more rows of numbers that are generally made up of the columns of numbers that normally appear on the BINGO flashboard. For example, the first row shown on the BINGO card in FIG. 2 includes the numbers 12, 27, 42, 57, and 72. This set of numbers is generally made up from the numbers in the $12^{th}$ column of numbers on the BINGO flashboard. In certain embodiments, a participant would only win the game if and when this first row of numbers was marked, corresponding to all the numbers being chosen in the $12^{th}$ column of the numbers on the BINGO flashboard. As also exemplified in FIG. 2, the BINGO card may have another row that corresponds to a specific column of numbers on the BINGO Dashboard. As shown, the second row on the BINGO card includes the numbers 3, 18, 33, 48, and 63, which generally make up the numbers in the $3^{rd}$ column of numbers on the BINGO flashboard. Additional certain embodiments may exist in which a participant would only win the game if and when this second row of numbers was marked, corresponding to all the numbers being chosen in the $3^{rd}$ column of the numbers on the BINGO flashboard.

As illustrated in FIG. 2, the numbers laid out in the first and second rows of the BINGO card have a certain order. In particular, the order of the numbers running across each row from left to right correspond to the exact order of the numbers laid out in the respective columns of the BINGO flashboard from top to bottom. The invention should not be limited as such. It should be appreciated that other embodiments may be employed in which certain rows of the BINGO card are created so that they contain all the numbers from the columns of the BINGO flashboard yet not in any specific order. Such other embodiments still fall within the spirit of the invention.

In other certain embodiments, in order to win using the BINGO card of FIG. 2, a participant would initially need to mark both the first and second rows of numbers. In further certain embodiments, not only would one need to mark both the first and second rows of numbers to be a winner, but the participant must need the rows to be completely marked in the order in which they appear going from top to bottom on the BINGO cards. For example, using the BINGO card of FIG. 2, the game could be organized such that a participant would only win if the $12^{th}$ column of numbers of the BINGO flashboard were completely selected first, followed by the $3^{rd}$ column of numbers of the BINGO flashboard being completely selected second. As such, all the symbols of the first row, including the numbers of the $12^{th}$ column of numbers on the flashboard, would have to be completely marked first before all the symbols of the second row, including the numbers of the $3^{rd}$ column of numbers on the flashboard, were completely marked. Consequently, the order in which the participant completes a series of marks on their BINGO cards (in the horizontal direction) would determine the winner.

As also exemplified by the BINGO card of FIG. 2, the fourth row may include numbers generally making up another column of numbers on the BINGO Dashboard. As shown, the fourth row includes the numbers 6, 21, 36, 51, and 66, and this set of numbers is generally made up from the numbers in the $6^{th}$ column of numbers on the BINGO flashboard. As such, a game, as described above, can be played that would require a participant to also mark in the fourth row before winning. In certain embodiments, the participant would only win if all the $12^{th}$ column of numbers of the BINGO flashboard were completely selected first, followed by all the $3^{rd}$ column of numbers of the BINGO flashboard being completely selected second, followed by all the $6^{th}$ column of numbers of the BINGO flashboard being completely selected third.

As illustrated, the third and fifth rows contain numbers not corresponding to any column of numbers found on the BINGO flashboard; however, these rows may indeed contain such numbers corresponding to columns of numbers even if a game is being played where such rows do not determine the winner. As shown, the numbers that are distributed in the third and fifth rows still involve numbers ranging from 1 to 75, without repeating any of the numbers previously used by the first, second, and fourth rows. As mentioned above, while not shown in FIG. 2, the fifth row of the BINGO card may also include a set of numbers generally made up from the numbers in the one of the columns of numbers on the BINGO flashboard, yet not already included in the first, second, or fourth rows. In certain embodiments, a game, as described above, could be played that would require a participant to completely mark all the symbol combinations in the first row, followed by the second row, followed by the fourth row, followed by the fifth row before winning. In certain embodiments, the participant would only win if the $12^{th}$ column of numbers of the BINGO flashboard were all completely selected first, followed by the complete selection of all the $3^{rd}$ column of numbers of the BINGO flashboard being selected second, followed by the complete selection of all the $6^{th}$ column of numbers of the BINGO Dashboard being selected third, followed by the complete selection of the column of numbers represented in the fifth row of the BINGO card fourth.

As shown, the third row contains a space, and as such, would generally not include a column of numbers from the BINGO flashboard. However, in certain embodiments, four of the five numbers from a column of numbers from the flashboard could be inserted in the third row and the space would represent an automatic mark. As such, completion of that row would involve only four numbers being selected. Subsequently, in following along with the embodiments from above, a game could be played in which the participant would only win if the $12^{th}$ column of numbers of the BINGO flashboard were completely selected first, followed by the $3^{rd}$ column of numbers of the BINGO flashboard being completely selected second, followed by the column of numbers represented in the third row of the BINGO card (wherein four out of five numbers need be marked) being completely selected third, followed by the $6^{th}$ column of numbers of the BINGO flashboard being completely selected fourth, followed by the column of numbers represented in the fifth row of the BINGO card being completely selected fifth.

In summary, the BINGO card would be designed so that one or more of its rows each contains respective numbers from one or more of the columns on a BINGO flashboard. If more than one row of the BINGO card is used to include more than one column of numbers respectively on the BINGO flashboard, the game, in certain embodiments, is only won if the participant completely marks the rows in the order in which they appear on the BINGO card, going from top to bottom, first row to fifth row. However, the present invention should not be limited to such embodiments. For example, the game may be varied so that the order by which the rows are completely marked does not always have to correspond with how the rows are disposed on the paper from top to bottom. In certain embodiments, the game can require that the rows on the BINGO card be completely marked in an order from bottom to top. FIG. 3, providing another exemplary BINGO card of the present invention, can be used to illustrate such a game. As can be seen, the BINGO card of FIG. 3 has the $5^{th}$ and $8^{th}$ columns of numbers from the BINGO flashboard of FIG. 1 respectively represented on the first two rows of the card. In using a bottom to top approach of producing a winner, a participant would only win if the $8^{th}$ column of numbers of the BINGO flashboard were completely selected first, followed by the $5^{th}$ column of numbers of the BINGO flashboard being completely selected second. As such, the game could be designed to require the rows to be completely marked in any of a variety of row orders, so long as the row order is established before the game is started.

Also, it should be appreciated that the present invention should not be limited to only correspondence between columns on the BINGO flashboard and rows appearing on the BINGO cards. For example, partial rows on the BINGO flashboard of FIG. 1 could correspond to columns appearing on the BINGO cards. In addition, it should be appreciated that the BINGO flashboard could be represented in any of a variety of differing arrays of numbers. For example, one example that is distinct from the five row, fifteen column distribution of numbers shown in FIG. 1 could be a fifteen row by five column distribution of the same 75 numbers. In certain embodiments, a BINGO flashboard having this 15×5 matrix may have three rows dedicated to each letter (e.g., the letter "B" would have three rows of numbers, one having numbers 1 to 5, one having numbers 6 to 10, and one having numbers 11 to 15. As such, by creating BINGO cards that have columns that correspond to the rows of this BINGO flashboard, one can have full rows of the BINGO flashboard correspond to columns of the BINGO card. As is obvious, the arrangement of the numbers of a BINGO Dashboard could be changed in a variety of ways, thus altering the game; however, not to an extent that is outside one aspect of the invention, wherein the representation of the numbers in the matrix dictates how winners of the game are determined.

While the above embodiments are described with respect to the game of BINGO, the present invention is generally applicable to any game that involves any matrix or array of symbols (or symbol combinations), wherein the symbols are selected (e.g., randomly) to provide a winner. For example, the lottery generally involves people choosing a certain quantity of numbers (e.g., six numbers) from a set of numbers (e.g., set of one-hundred numbers ranging from 1 to 100), with such participants receiving a ticket thereto containing such numbers chosen by the participant. Subsequently, facilitators of the lottery game hold a drawing of the certain quantity of numbers from the set of numbers every so often (e.g., every week), and the tickets sold for such drawing and sold before such drawing are used by the participants to see if their chosen numbers match the numbers drawn.

The set of numbers of a lottery game from which the certain quantity of winning numbers is chosen could be represented in any number of different matrices, e.g., a 10×10 matrix as illustrated in FIG. 4, including a certain number of rows and columns. Creating this matrix and informing lottery participants of the matrix (e.g., displaying the matrix) would enable facilitators to provide additional ways for participants to win when playing the lottery, and would enable participants different ways in which to play the lottery game. For example, if the numbers chosen or drawn by the lottery facilitators included numbers from one of a certain row or column from the matrix, and the lottery participant predicted this, the participant would win. Obviously, since the odds of choosing that the numbers picked by the facilitators would end up in one row or column are more likely than predicting the exact numbers picked, the winners would probably receive less than a winning share of the lottery jackpot. However, having more winners and more chances to win may increase game interest and participation. It should be appreciated that the participants could also predict the picked numbers to be in any combination of rows and/or columns. For example, if facilitators chose six numbers for every lottery drawing, a participant could predict, for instance, that the six numbers would fall under the $1^{st}$ row and/or the $3^{rd}$ column, and as such, given such matrix shown in FIG. 4, the numbers selected during the drawings would need to range from 1 to 10 and/or include 13, 23, 33, 43, 53, 63, 73, 83, and 93 for the participant to be a winner.

One can also use this method of playing and providing a winning participant in the game of BINGO in combination with a technique that is generally used when wagering on racing events; however, it is to be appreciated that the invention is not limited to such. In certain embodiments, the game could be marketed similarly to wagering on horse racing. As is known, horse racing generally involves a plurality of horses, each running against each other over a certain distance to see which horse crosses a finish line first. People who watch horse races generally wager on certain horses that they feel will finish first in the race (beat all the other horses in crossing the finish line). Predicting which horse wins a race generally pays the winner a nominal fee, unless the horse has a low potential (e.g., is considered a long shot) to win the race. To increase the winnings one can earn from a race, instead of wagering on long shots, one can try to predict how two or more horses will finish in the race. This is more difficult to predict than just picking the race winner, and as such, gives the successful predictor increased earnings. Such predictions can include exactas (picking the top two finishers in exact order of finish), trifectas (picking the top three finishers in exact order of finish), superfecta (picking the top four finishers in exact order of finish), and quinellas (picking the top two finishers regardless of the order). Other predictions that can be made which involve picking the winners of a plurality of races include the daily double (picking the winners of the first two races), the pick 3 (picking the winners of three consecutive races), pick 4 (picking the winners of four consecutive races), the pick 5 (picking the winners of five consecutive races), and pick 6 (picking the winners of six consecutive races).

Like horse racing, the fifteen columns of numbers on the BINGO Dashboard could each be represented by a specific number. As described above, in certain embodiments, the first number listed in each column would correspond with the number associated for that column. As such, in certain embodiments, the fifteen columns would be referenced as columns 1 through 15. In purchasing the BINGO card(s) before the game, the participant would be able to glance at the card(s) and realize which columns need to be completely selected first, and second if appropriate, and third and fourth and fifth if appropriate, in order to win. As such, the participant will be rooting for certain column(s) of numbers to be completely selected, and that such column(s) of numbers be completely selected in the certain order that the columns are laid out on his specific BINGO card so that he can win. However, it may be presumed as somewhat silly to root for a column(s) of numbers, thus, instead of referencing the columns of numbers simply by number, the idea is to attach the number to a horse. In turn, the idea is that all fifteen columns are competing against one another similar to horses in a race of a certain distance. As soon as all the numbers of any specific column of numbers are selected, the column number referenced by a specific horse of the same number, is said to have crossed the finish line. If all the numbers for the specific column were completely selected before all of the numbers of any of the other columns were completely selected, the horse referencing that specific column of numbers of the BINGO flashboard would be the winner.

In certain embodiments, a participant may purchase the BINGO card of FIG. 2. In addition, let's presume that the game being played is the "exacta". According to the BINGO card of FIG. 2, the participant would only win, and thus be rooting for the complete selection of the all numbers in column 12 first, followed by column 3 (or the exact finish of the 12 horse followed by the 3 horse). As such, the $12^{th}$ column of numbers of the BINGO Dashboard would need to be entirely selected before the $3^{rd}$ column of numbers of the BINGO flashboard were entirely selected. For the 12 horse to finish first, all five numbers in the $12^{th}$ column (12, 27, 42, 57, 72) would need to be completely called before any of the other fourteen columns had all of their respective five numbers selected and optionally, lit on the BINGO flashboard. For the 3 horse to finish second, after all five numbers in the $12^{th}$ column (12, 27, 42, 57, 72) have been selected, the $3^{rd}$ column of numbers (3, 18, 33, 48, 63) would have to be completely selected before the numbers of any of the other thirteen columns have been completely selected and optionally, lit on the BINGO Dashboard.

In other embodiments, the game being played instead could be the "trifecta". According to the BINGO card of FIG. 2, the participant would only win, and thus be rooting for the complete selection of all the numbers of column 12 first, followed by the complete selection of all the numbers of column 3 second, followed by the complete selection of all the numbers of column 6 third (or the exact finish of the 12 horse followed by the 3 horse followed by the 6 horse), where the $12^{th}$ column of numbers of the BINGO Dashboard would be completely selected first, followed by the $3^{rd}$ column of numbers of the BINGO Dashboard being completely selected second, followed by the $6^{th}$ column of numbers of the BINGO Dashboard being completely selected third. It should be appreciated that games can similarly be played with attention to four rows, each having numbers corresponding to differing columns of numbers from the BINGO Dashboard. The game played would be the "superfecta", where the four rows of numbers would have to completely selected in the exact order as they appear on the BINGO card from top to bottom. Similarly, in certain embodiments, games can be played with attention to five rows, with certain concessions made with respect to the third row and the free space, as described above.

While the above embodiments are described with respect to the game of BINGO where columns of numbers on the BINGO Dashboard need to be selected or completed in a certain fashion or order to facilitate a winner, the present invention is generally applicable to any game that involves any matrix or array of symbols (or symbol combinations), wherein certain segments of the matrix need to be selected in a specific order to provide a winner. For example, BINGO could still be used as the game choice; however, the columns of a typical 5×5 BINGO card need to be completely marked instead of the rows to provide a winner. In certain embodiments, the matrix of numbers on the BINGO Dashboard (5 rows by 15 columns) can be changed so as only include the first five numbers of each row in the set of numbers that is selected by the facilitator of the game. As such, the matrix of numbers would comprise 5 rows by 5 columns, totaling twenty-five numbers, and the five rows of the BINGO flashboard would correspond to what would need to be selected for the columns of the BINGO card to be completely marked to produce a winner.

In addition, the present invention is generally applicable to any game that involves having a certain plurality of events occur to facilitate a winner. In certain embodiments, the plurality of events would need to occur in a specific order to facilitate a winner. For example, with the above "exacta" case, two columns of numbers from the BINGO flashboard must be completely selected in a particular order before a winner is possible. In general, the invention is applicable to any game whereby participants receive recorded scenarios (e.g., game tickets) displaying one specific scenario of how events could possibly transpire or occur during the game. The game would in turn be played and if the recorded scenario held by any participant actually transpired during the game, the respective participant would communicate that he has the winning recoded scenario. In certain embodiments, the total number of possible event scenarios would be calculated, as exemplified below, and a corresponding number of recorded scenarios would be created (each including one of the total number of event scenarios) and distributed to the participants. In turn, the number of winners could be limited if desired since the game would only transpire according to one actual event scenario. However, if the number of winners was not a concern, it should be appreciated that participants could predict the order themselves and receive a recorded scenario based on their prediction.

Figure 5:
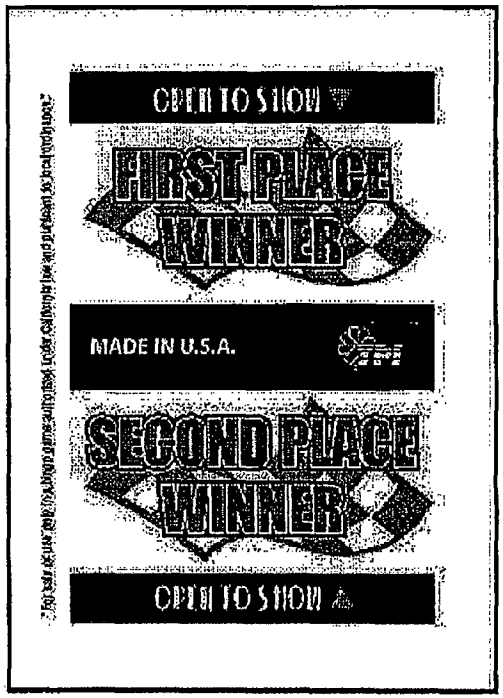
FIG. 5 is a plan view of a ticket illustrating a possible scenario for an event in accordance with exemplary embodiments of the invention.
Figure 5:
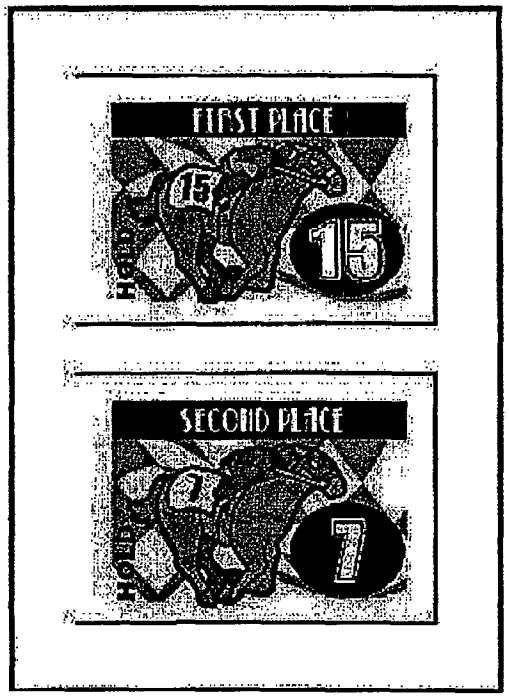
Figure 5:
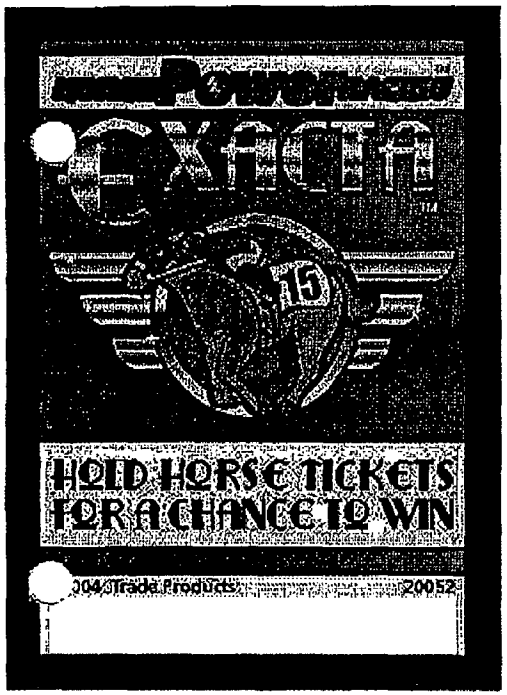

FIG. 5 shows an example of a recorded scenario for a horse race. As shown, the recorded scenario shows three segments of a pull-tab ticket going from left to right. The first segment indicates the game being played, "Horse Racing Power Exacta". The third segment indicates the number of tabs needing to be pulled on the ticket, and what the information underneath the tabs represents. Finally, the second segment provides the scenario that is needed for the participant to win. In this case, the 15 horse would need to finish first, and the 7 horse would need to finish second for the participant to have a winning ticket. In reference to the BINGO Dashboard referenced above having a 5 row by 15 column matrix of numbers, the $15^{th}$ column of numbers on the Dashboard would have to be selected first, followed by the $7^{th}$ column of numbers on the flashboard being completed or selected second. As can be appreciated, this pull-tab ticket is applicable to the BINGO game as indicated above, or any other game that involves having a certain plurality of events (wherein the events are individually referenced as specific horses) occur in a specific order to facilitate a winner. In addition, with respect to BINGO, the ticket holder does not need to be playing with a BINGO card in order to win with the ticket. As a result, BINGO cards do not even need to be sold to produce winners to the game.

In certain embodiments, a game may involve selections being made from a non-BINGO related matrix of numbers, wherein winners result from a grouping (e.g., row, column, etc.) of the numbers being completely selected first before any other similar groupings of numbers are completely selected from the matrix of numbers. Likewise, a game may involve selections being made from a non-BINGO related matrix of numbers, wherein winners result from a plurality of groupings (e.g., rows, columns, etc.) of the numbers being selected, wherein the groupings are completely selected in a certain order. As such, other games not related to BINGO, yet using matrices of numbers could be played in accordance with the invention.

Figure 6:
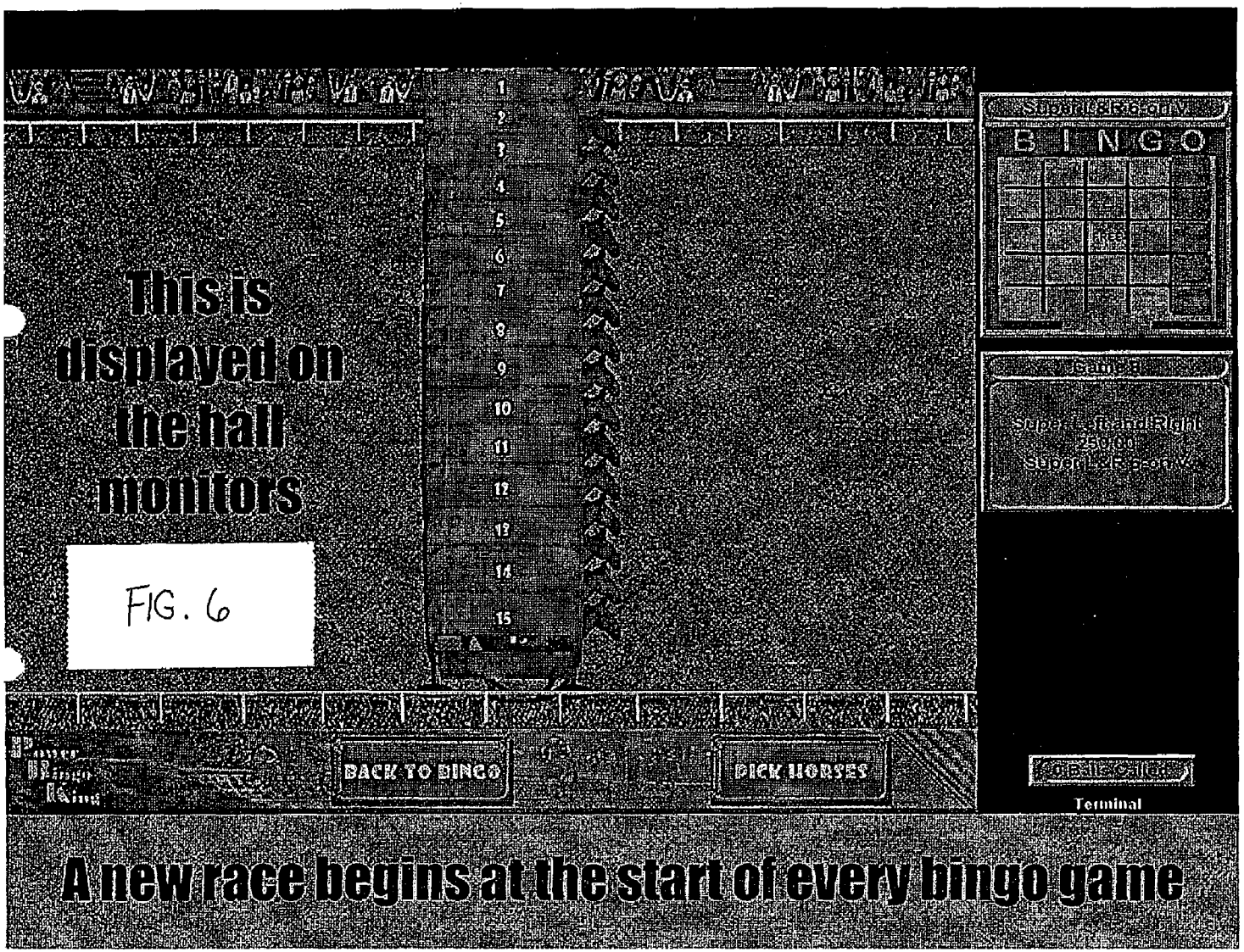
FIG. 6 is a screen shot of a starting gate of a horse race illustrating the horses before a game in accordance with exemplary embodiments of the invention.
Figure 7:
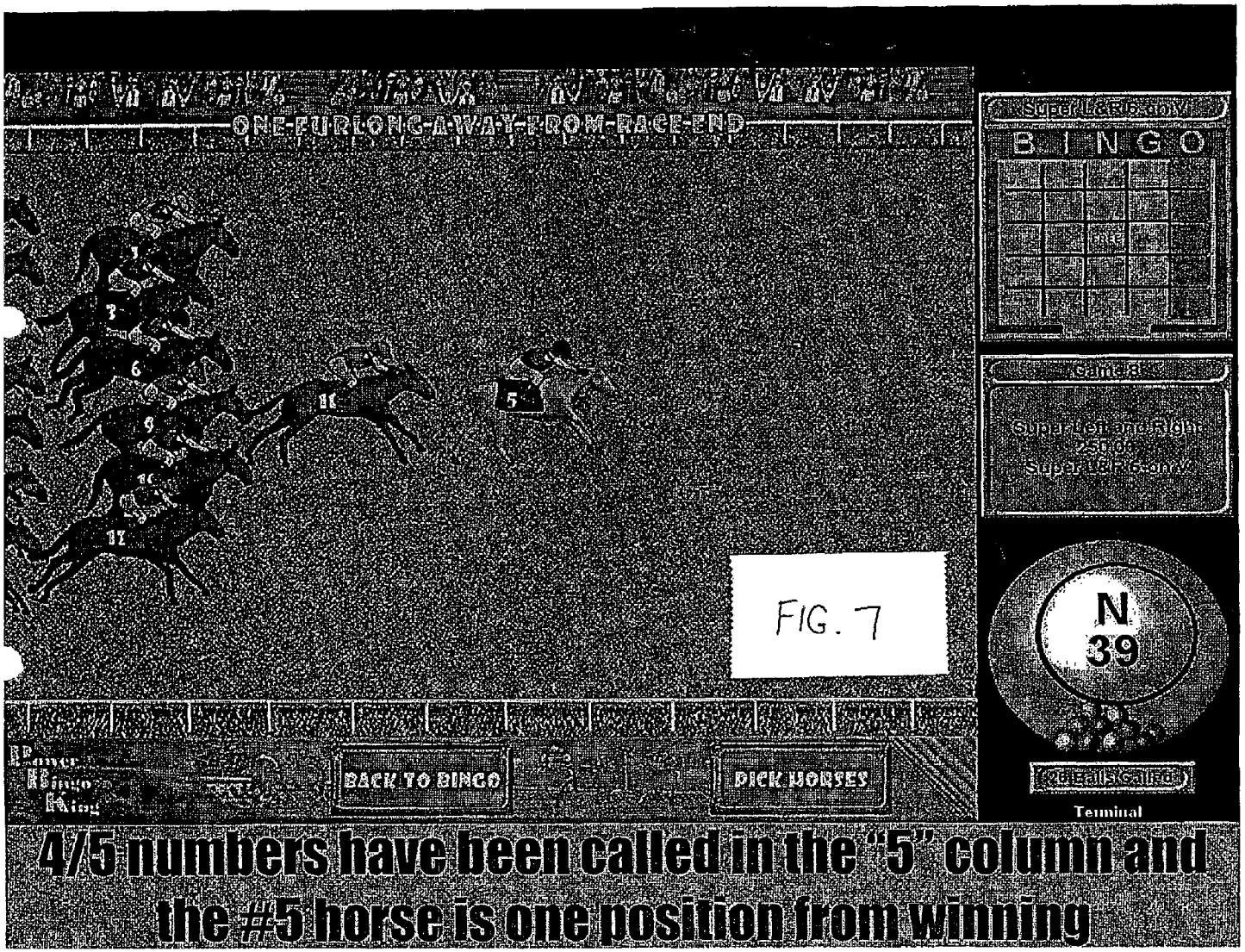
FIG. 7 is a screen shot of a horse race illustrating the horses during a game in accordance with exemplary embodiments of the invention.
Figure 8:
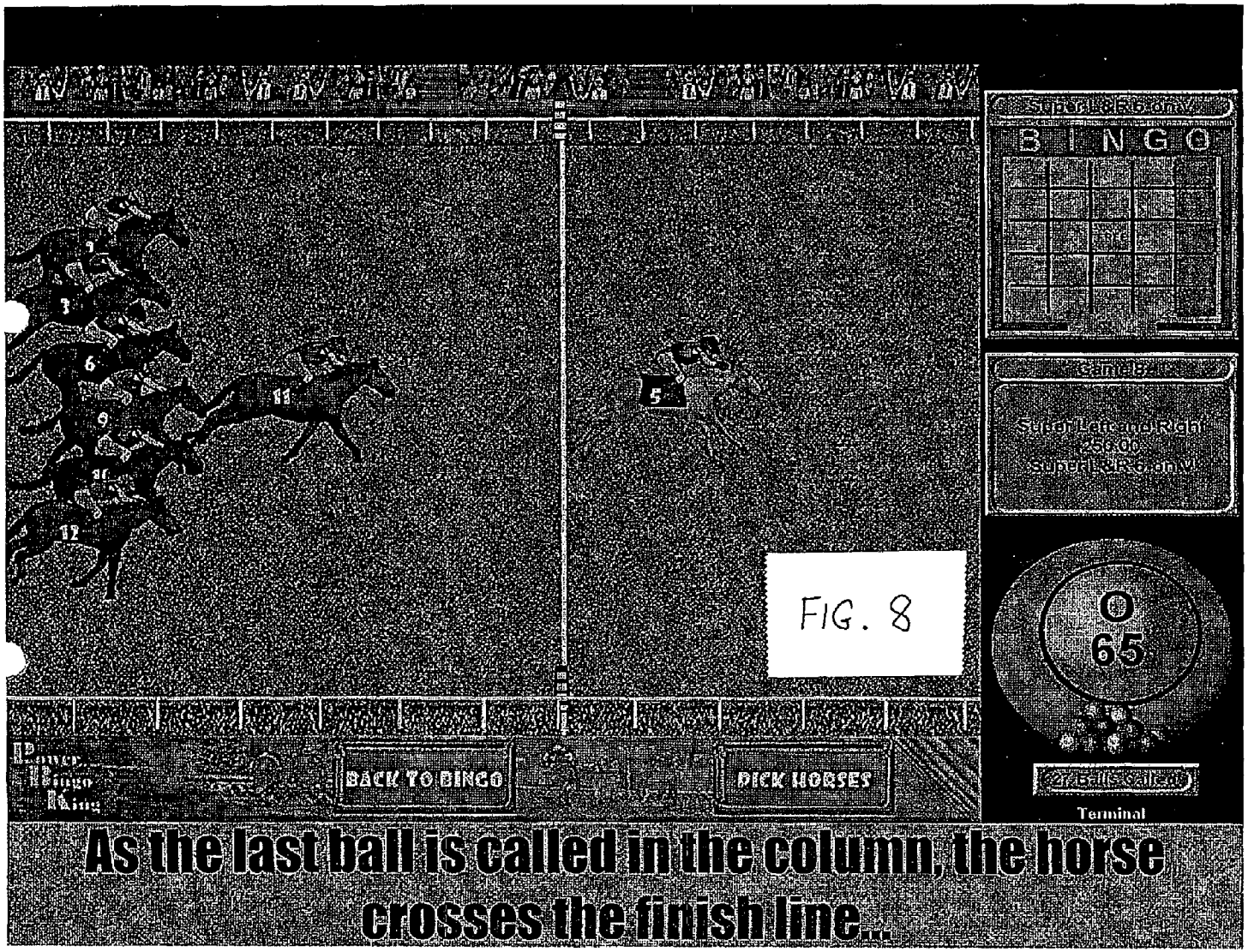
FIG. 8 is a screen shot of a horse race illustrating the horses during a game in accordance with exemplary embodiments of the invention.

In certain embodiments of the invention, to create more of a racing atmosphere, a visual display would be used, exemplified in FIG. 6, illustrating horses, numbered 1 to 15, at a starting gate, where each numbered horse represents the corresponding numbered column of numbers on the BINGO flashboard. The horses are shown even at the starting gate before the game; however, once the BINGO game begins and the symbols begin to be selected, the horses start to separate from one another. For example, the $1^{st}$ column of numbers on the BINGO flashboard represents the distance the number 1 horse has to run in the race to cross the finish line, the $2^{nd}$ column of numbers represents how far the number 2 horse has to run in the race to cross the finish line, and so on and so forth. As such, each horse needs to have five specific numbers selected before it can cross the finish line. If, for example, the first symbol selected is "B5", "B5" is located in the $5^{th}$ column of the exemplary BINGO Dashboard of FIG. 1. Subsequently, since one of the numbers in the $5^{th}$ column has been selected, the number 5 horse will be shown breaking away from the other horses, and as such, will be a fifth of the way toward crossing the finish line and winning the race. As more symbols are selected, each of the corresponding horses will respectively start to move from the starting gate and closer to the finish line. During the game, as more and more numbers are called, the horses will generally start to spread out from each other. For example, as shown in FIG. 7, the number 5 horse is leading the race, and as such, it can be assumed that the $5^{th}$ column of the BINGO Dashboard has had the most numbers selected therefrom. However, the number 11 horse is close behind the number 5 horse and as such, it can be assumed that the $11^{th}$ column of the BINGO Dashboard has had the second most numbers selected therefrom. All the other horses trail the number 5 and number 11 horses, and it can be assumed that the other respective columns of the BINGO Dashboard have had fewer numbers selected therefrom than either the $5^{th}$ and $11^{th}$ column of numbers. In certain embodiments, the number 5 horse may win the race, as shown in FIG. 8. As such, all five numbers in the $5^{th}$ column (i.e., 5, 20, 35, 50, 65) of the BINGO Dashboard will have been completely selected before the numbers of any of the other fourteen columns of the BINGO Dashboard have been completely selected. With the visual display, it will be easier for participants to see how the game is progressing and what numbers will generally produce a winner, provided someone is playing the corresponding winning recorded scenario (e.g., winning BINGO card).

While the above embodiments are described with respect to the game of BINGO, the present invention is generally applicable to any game in which overall progress in the game can be divided between a start of the game and a finish, and as such a display can be used to chart the progress of every participant in the game. In addition, while the above embodiments are described with respect to horse racing, the present invention is generally applicable to any racing event where participants are numbered and are required to race each other over a certain distance. Such racing events could include, but should not be limited to, other animal races, such as greyhound racing, foot races for people, such as steeple races, and vehicular racing, such as auto racing. Further, the present invention is applicable to BINGO games being manually provided in the traditional environment, but should not be limited as such. For example, the present invention is also applicable to BINGO games being electronically provided, e.g., over a handheld electronic machine. Finally, this game is applicable to games run using more than one number grid (matrix) per BINGO card. With this set-up, for example, with two BINGO cards placed on one sheet, "daily double", "pick 3", and related games can also be played.

In certain embodiments, the number of winners per game is limited to just one participant. As such, only a certain permutation or set of BINGO cards is printed so as to guarantee that only one winning card can be purchased and used. For example, in reference to FIG. 2, and supposing a "trifecta" game is being played, the winner of the game generally needs to have three columns of numbers from the BINGO Dashboard be completely selected in the exact order as the corresponding first three full rows on his BINGO card. As such, a calculation can be used to eliminate any possibility of multiple winners. For example, in the case of the "trifecta" game, the maximum number of columns from the BINGO Dashboard (e.g., possible winning horses) that could be placed in the first row is fifteen. With no columns being used twice, the maximum number of columns from the BINGO Dashboard that could be placed in the second row (e.g., number of horses finishing second) is fourteen. Again, with no columns being used twice, the maximum number of columns from the BINGO Dashboard that could be placed in the fourth row (e.g., number of horses finishing third) is thirteen. As such, the permutation of BINGO cards that should be produced is equal to 15 multiplied by 14 multiplied by 13, totaling 2,730 total BINGO cards that can be produced and still guarantee only one winning card. With this limit, it is possible that the winning card is not sold if fewer than 2,730 cards are purchased. As such, the game providers can roll the prize or jackpot over to the following game until a winning card is purchased.

Similar calculations can be made with respect to other similar games, including but not limited to the "exacta" and "superfecta" games. The "exacta" game would have a permutation size of 210 BINGO cards (15 multiplied by 14), whereas the "superfecta" game would have a permutation size of 32,760 BINGO cards (15 multiplied by 14 multiplied by 13 multiplied by 12). It should be appreciated that this same calculation could be varied accordingly given changes to elements of the game (e.g., change in number of columns and/or rows of the BINGO flashboard), and changes in which the game is played (e.g., change in number of things that need to occur before a winner can be facilitated).

Figure 9:
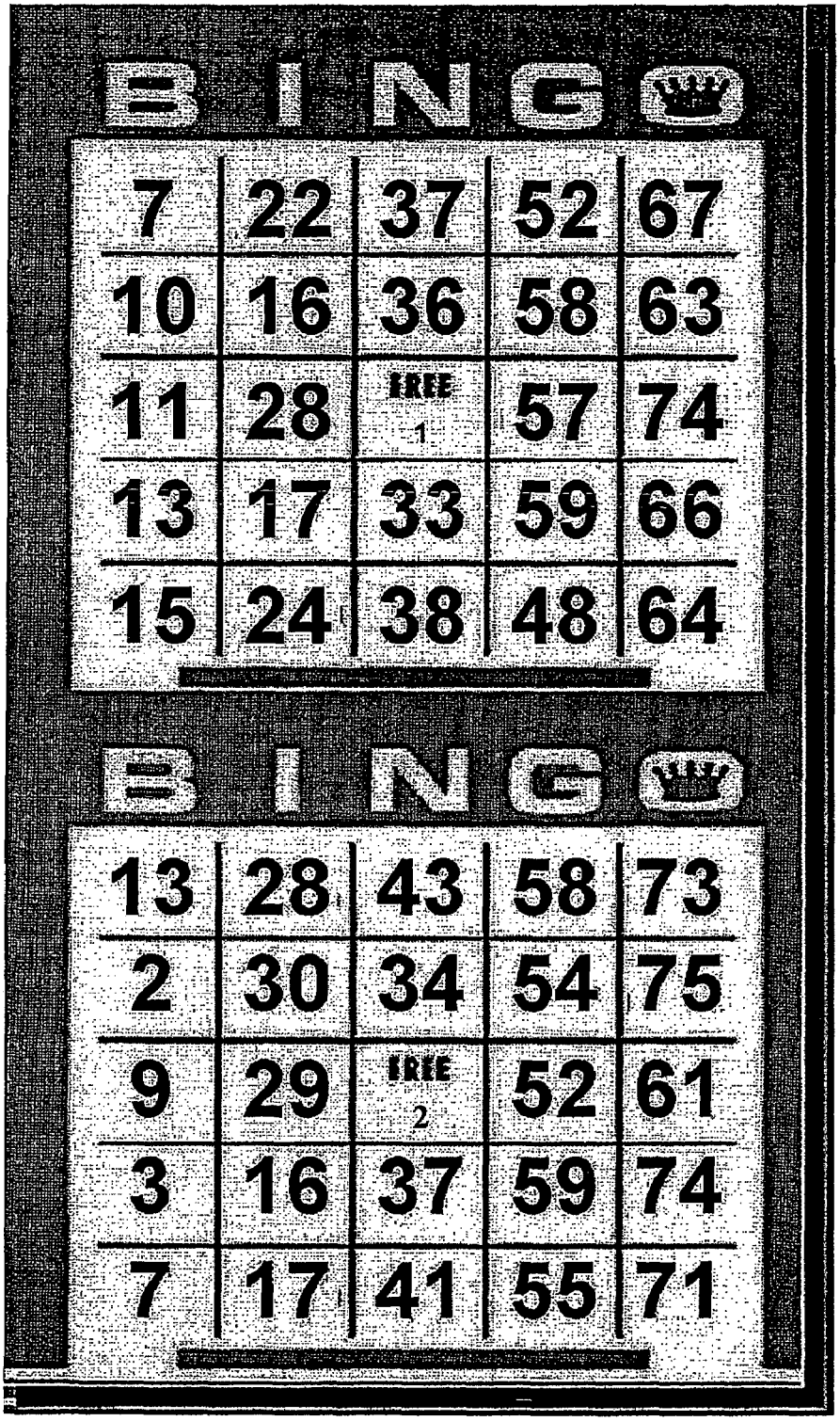
FIG. 9 is a plan view of a sheet containing two BINGO cards in accordance with exemplary embodiments of the invention.

In addition, similar calculations can be made with respect to other games as well. For example, in reference to games in which the winners of multiple events are predicted. As such, the games would have a plurality of BINGO cards on a single sheet corresponding to the number of events that are being predicted. For example, with the "daily double", two BINGO cards, as exemplified in FIG. 9, would be provided on a single sheet and participants would need to have two columns of numbers from the BINGO flashboard be completely selected in the exact order of the corresponding first rows of each BINGO card on the sheet to provide a winner. For example, as shown in FIG. 9, in certain embodiments, if a game involved two games with the top BINGO card being played in the first game and the bottom BINGO card being played in the second game, a participant would need the $7^{th}$ column of numbers to be completely selected first from the BINGO flashboard of FIG. 1 in the first game, and the $13^{th}$ column of numbers to be completely selected first from the BINGO flashboard of FIG. 1 in the second game to win. As such, a calculation can be used to eliminate any possibility of multiple winners. For example, in the case of the "daily double" game, the maximum number of columns from the BINGO flashboard (e.g., possible winning horses) that could be placed in the first row of the first BINGO card on the single sheet (going from left to right) is fifteen. Similarly, the maximum number of columns from the BINGO flashboard that could be placed in the first row of the second BINGO card on the single sheet (e.g., possible winning horses) is again fifteen. As such, the permutation of BINGO cards that should be produced is equal to 15 multiplied by 15, totaling 225 total sheets, each having two BINGO cards thereon, so as guarantee only one winning card. With this limit, it is possible that the winning card is not sold if fewer than 225 sheets are purchased. As such, the game providers can roll the prize or jackpot over to the following game until a winning card is purchased.

Figure 10:
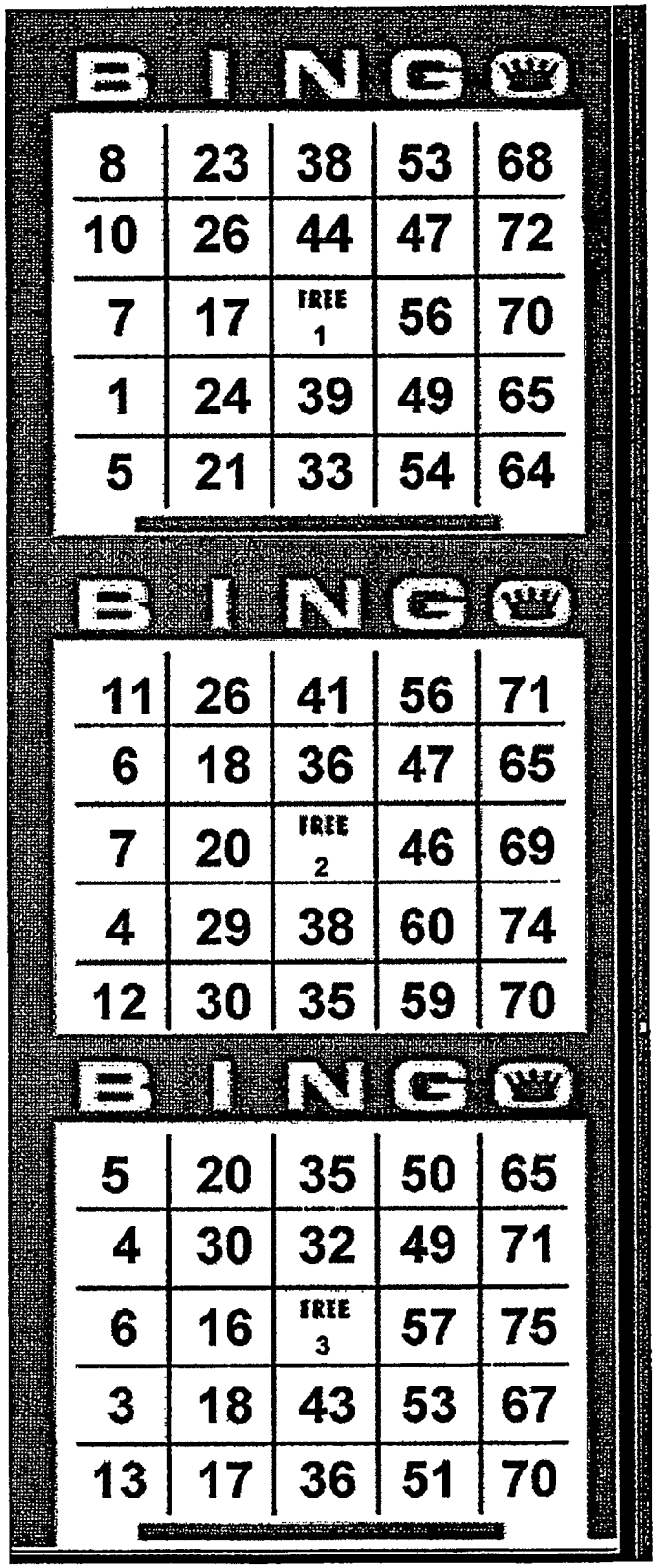
FIG. 10 is a plan view of a sheet containing three BINGO cards in accordance with exemplary embodiments of the invention.

Similar calculations can be made with respect to other similar games, including but not limited to the "PIK 3" and "PIK 4" games. As exemplified in FIG. 10, "PIK 3" would involve three BINGO cards provided on a single sheet and participants would need to have three columns of numbers from the BINGO Dashboard be completely selected in the exact order of the corresponding first rows of each BINGO card on the sheet to provide a winner. For example, as shown in FIG. 10, in certain embodiments, if a game involved three games with the top BINGO card being played in the first game, the center BINGO card being played in the second game, and the bottom BINGO card being played in the third game, a participant would need the $8^{th}$ column of numbers to be selected first from the BINGO Dashboard of FIG. 1 in the first game, the $11^{th}$ column of numbers to be completely selected first from the BINGO Dashboard of FIG. 1 in the second game, and the $5^{th}$ column of numbers to be completely selected first from the BINGO flashboard of FIG. 1 in the third game to win. The "PIK 3" game would have a permutation size of 3,375 BINGO cards (15 multiplied by 15 multiplied by 15), whereas the "PIK 4" game would have a permutation size of 50,625 BINGO cards (15 multiplied by 15 multiplied by 15 multiplied by 15). It should be appreciated that this same calculation could be varied accordingly given changes to elements of the game (e.g., change in number of columns and/or rows of the BINGO flashboard), and changes in which the game is played (e.g., change in the number of things that need to occur per sheet before a winner can be facilitated).

In another case, a "quinella" game may be played. As such, the winner of the game needs to have two columns of numbers from the BINGO Dashboard be completely selected in any order as the corresponding first two rows on his BINGO card. In creating a permutation of BINGO cards for this game, the formula would be similar to the "exacta" game, with 210 BINGO cards (15 multiplied by 14) in the permutation; however, in this case, there would be a chance for multiple winners as the winning combination (e.g., the 1 horse finishing first and the 2 horse finishing second) would be exhibited twice in the permutation of BINGO cards. As such, in certain embodiments, the permutation can be cut in half to 105 (e.g., eliminating all the BINGO cards that exhibits a first row corresponding to a first column number on the BINGO Dashboard and a second row corresponding to a second column number on the BINGO flashboard, wherein the first column number is larger than the second column number) to guarantee only one winner.

The present invention provides many embodiments, some of which are discussed below. Embodiments of games are provided herein which use matrices of numbers, wherein the representation of the numbers in the matrix dictates how winners of the game are determined. Other embodiments of games are provided herein which involve certain events occurring during the playing of the games, wherein the specific order by which the events occur dictates how winners of the game are determined. Further embodiments of games are provided herein where a visual display is used to illustrate the timeline and/or various stages of the game, wherein participants of the game are able to use the display to see how the game is progressing and how the game may be won.

It should be appreciated herein that a reference made to a first column of numbers being completely selected before a second column of numbers is completely selected is not meant to mean that all the numbers in the first column must be chosen before any of the numbers in the second column are chosen. While this scenario may occur and is within the spirit of the invention, what is instead generally meant is that the first column of numbers is completely selected (e.g., 5 out of 5 numbers in a column have been chosen) before the second column of numbers is completely selected (e.g., the second column having a quantity of less than the full set of numbers of the second column selected). As such, the second column of numbers can have any series of numbers already chosen when the first column is completely selected so long as the series of numbers does not include all of the numbers of the second column.

While a preferred embodiment of the present invention has been described, it should be understood that various changes, adaptations, and modifications may be made therein without departing from the spirit of the invention.

What is claimed is:

1. A method of playing a game comprising:

providing a flashboard including a matrix of spaces, each flashboard matrix space occupied by a symbol, each symbol being distinct, each symbol being located in one of a plurality of rows extending across the flashboard matrix in a first direction and in one of a plurality of columns extending across the flashboard matrix in a second direction;

distributing to each of a plurality of game participants at least one of a set of cards configured for use with the flashboard in playing the game, each of the set of cards including at least one matrix of spaces, each card matrix being occupied by a set of the symbols in the flashboard matrix, each set of symbols of each card matrix being arranged in a plurality of groupings, the symbols of one or more of the groupings on each card matrix matching the symbols in one of the plurality of columns or one of the plurality of rows extending across the flashboard matrix;

using a visual display during the playing of the game, the visual display illustrating a contest including a plurality of contestants, each contestant representing a distinct one of the plurality of rows or the plurality of columns on the flashboard matrix having the symbols that match with one of the one or more groupings of symbols on each card matrix;

selecting randomly the symbols of the flashboard until at least one game participant wins the game, the visual display enabling the game participants during the game to determine their own status and the other game participants' statuses in the game based on progress of the contestants in the contest, the progress of any of the contestants in the contest being based on quantity of the symbols selected from the one row or one column on the flashboard that corresponds to the contestant; and winning the game by one of the game participants when the symbols of the one or more groupings on one card matrix of the one game participant are selected before the symbols of the one or more groupings on corresponding card matrices of any other game participant are selected, whereby selection of the symbols of the one or more groupings on the one card matrix correlate with the corresponding contestants finishing the contest, wherein the contest comprises a racing contest and each contestant comprises a racing participant, wherein the racing participants' progress in the racing contest is measured by various stages of the racing contest that the participants are configured to complete on the visual display, and wherein the stages correspond to the symbols of the one or more groupings representing the racing participants.

2. The method of claim 1 wherein each card includes two or more matrices, and wherein a plurality of the distinct symbols of the flashboard matrix are selected randomly for each of the two or more matrices.

3. The method of claim 2 wherein the winning step at least involves:

a) the symbols of the one or more groupings on a first matrix of the one card of the one game participant being selected before the symbols of any of the other one or more groupings on a first matrix of the other distributed cards are selected, and b) the symbols of the one or more groupings on a second matrix of the one card of the one game participant being selected before the symbols of any of the other one or more groupings on a second matrix of the other distributed cards are selected.

4. The method of claim 1 wherein the one or more groupings comprises two or more groupings.

5. The method of claim 4 wherein each of the two or more groupings comprises a distinct row on each card matrix.

6. The method of claim 5 wherein the symbols in each of the rows comprising the two or more groupings on each card matrix match the symbols in one of the plurality of columns extending across the flashboard matrix.

7. The method of claim 4 wherein the two or more groupings on each card matrix comprise a first grouping and a second grouping, wherein winning the game occurs only when all the symbols of the first grouping are selected before all the symbols of the second grouping on the one participant's card matrix.

8. The method of claim 1 wherein the racing contest ends when one of the racing participants completes the racing contest before any other racing participant, wherein the one racing participant corresponds to the selected symbols of the one or more groupings on the one card matrix of the one game participant.

9. The method of claim 1 wherein the one or more groupings comprises two or more groupings, wherein the racing contest ends when two or more of the racing participants complete the racing contest before any other racing participant, wherein the two or more racing participants correspond to the selected symbols of the two or more groupings on the one card matrix of the one game participant.

10. The method of claim 8 wherein the two or more groupings on each card matrix correspond to a first racing participant and a second racing participant, wherein winning the game occurs only when all the symbols of the one or more groupings representing the first racing participant are selected before all the symbols of the one or more groupings representing the second racing participant are selected on the one card matrix of the one game participant.

11. The method of claim 1 wherein the racing participants' progress in the racing contest is measured by a distance on the visual display over which the participants are configured to travel, and wherein the distance corresponds to the symbols of the one or more groupings representing the racing participants.

12. A method of playing a game comprising:

providing a flashboard including a matrix of spaces, each flashboard matrix space occupied by a symbol, each symbol being distinct, each symbol being located in one of a plurality of rows extending across the flashboard matrix in a first direction and in one of a plurality of columns extending across the flashboard matrix in a second direction;

assigning a distinct number to each of the plurality of rows or the plurality of columns such that each distinct number corresponds to one row or one column;

distributing to each of a plurality of game participants at least one of a set of physically distinct tickets configured for use with the flashboard, each ticket including a set of two or more of the distinct numbers incorporated thereon, each set of the two or more numbers being distinct;

using a visual display during the playing of the game, the visual display illustrating a contest including a plurality of contestants, each contestant corresponding to a distinct one of the numbers;

selecting randomly the symbols of the flashboard until at least one game participant wins the game, the visual display enabling the game participants during the game to determine their own status and other participants' statuses in the game based on progress of the contestants in the contest, the progress of any one of the contestants in the contest being based on quantity of the symbols selected from the row or column on the flashboard that corresponds to the number of the contestant; and winning the game by one of the game participants when the symbols in the rows or columns of the flashboard corresponding to the distinct numbers on one ticket of the one game participant are selected before the symbols in the rows or columns of the flashboard corresponding to the distinct numbers on the tickets of any other game participant are selected, whereby selection of the symbols of the in the rows or columns corresponding to the distinct numbers on the one ticket correlate with the corresponding contestants finishing the contest, wherein the contest comprises a racing contest and each contestant comprises a racing participant, wherein the racing participants' progress in the racing contest is measured by various stages of the racing contest that the racing participants are configured to complete on the visual display, and wherein the stages correspond to the symbols of each of the plurality of rows or the plurality of columns assigned with one of the numbers.

13. The method of claim 12 wherein the distinct numbers are assigned to each of the plurality of columns.

14. The method of claim 12 wherein each ticket includes first and second distinct numbers incorporated thereon, wherein winning the game occurs only when all the symbols corresponding to the first distinct number are selected before all the symbols corresponding to the second distinct number are selected.

15. The method of claim 12 wherein each ticket comprises a pull tab ticket, further comprising pulling the tabs from each of the tickets by the game participants to reveal the distinct numbers incorporated thereon.

16. The method of claim 12 wherein the racing contest ends when two or more of the racing participants complete the racing contest before any other racing participant, wherein the two or more racing participants correspond to the distinct numbers on the one ticket of the one game participant.

17. The method of claim 16 wherein the two or more distinct numbers on the one ticket correspond to a first racing participant and a second racing participant, wherein winning the game occurs only when all the symbols corresponding to the first racing participant are selected before all the symbols corresponding to the second racing participant are selected on the one ticket of the one game participant.

18. The method of claim 12 wherein the racing participants' progress in the racing contest is measured by a distance on the visual display over which the participants are configured to travel, and wherein the distance corresponds to the symbols of each of the plurality of rows or the plurality of columns assigned with one of the numbers.

* * * * *

UNITED STATES PATENT AND TRADEMARK OFFICE

CERTIFICATE OF CORRECTION

PATENT NO. : 7,562,875 B2
APPLICATION NO. : 11/241246
DATED : July 21, 2009
INVENTOR(S) : Morin et al.

It is certified that error appears in the above-identified patent and that said Letters Patent is hereby corrected as shown below:

Title Page, Assignee: delete "Des Moines, IA" and insert -- Omaha, NE --.

Signed and Sealed this

Third Day of November, 2009

David J. Kappos

David J. Kappos
*Director of the United States Patent and Trademark Office*